US007926857B2

(12) United States Patent
Akizuki et al.

(10) Patent No.: US 7,926,857 B2
(45) Date of Patent: Apr. 19, 2011

(54) DOOR LOCK DEVICE FOR VEHICLE

(75) Inventors: Ryujiro Akizuki, Kariya (JP); Takashi Nishio, Kariya (JP); Yusuke Yamada, Chiryu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 12/677,763

(22) PCT Filed: Dec. 22, 2008

(86) PCT No.: PCT/JP2008/073357

§ 371 (c)(1),
(2), (4) Date: Mar. 11, 2010

(87) PCT Pub. No.: WO2009/087892

PCT Pub. Date: Jul. 16, 2009

(65) Prior Publication Data

US 2010/0171321 A1 Jul. 8, 2010

(30) Foreign Application Priority Data

Jan. 10, 2008 (JP) ..... 2008-003465

(51) Int. Cl.
*E05C 3/06* (2006.01)
*E05C 3/00* (2006.01)

(52) U.S. Cl. ..... 292/201; 292/216

(58) Field of Classification Search ..... 292/201, 292/216

See application file for complete search history.

(56) References Cited

U.S. PATENT DOCUMENTS

| | | | | |
|---|---|---|---|---|
| 4,900,074 | A * | 2/1990 | Kleefeldt et al. | 292/216 |
| 5,092,638 | A * | 3/1992 | Mizuki | 292/216 |
| 5,531,488 | A * | 7/1996 | Yoshikuwa et al. | 292/216 |
| 5,762,383 | A * | 6/1998 | Gomi | 292/216 |
| 5,921,594 | A * | 7/1999 | Bendel | 292/216 |
| 6,367,296 | B1 * | 4/2002 | Dupont | 70/257 |

(Continued)

FOREIGN PATENT DOCUMENTS

JP 60-35868 U 3/1985

(Continued)

OTHER PUBLICATIONS

International Search Report issued on Mar. 23, 2009 by the Japanese Patent Office in its capacity as the International Searching Authority in International Application No. PCT/JP2008/073357.

*Primary Examiner* — Carlos Lugo
(74) *Attorney, Agent, or Firm* — Buchanan Ingersoll & Rooney PC

(57) ABSTRACT

A vehicle door lock device is provided. The vehicle door lock device includes a latch mechanism, an inside lever, an inside open lever, a bushing, a child protector lever, and an intermediate lever. The inside lever is operable from a passenger compartment side of a vehicle and supported pivotally about a support pin arranged in the vehicle door. The intermediate lever includes a guide hole, which receives the support pin. When pushed by the child protector lever as the child protector lever pivots, the intermediate lever pushes the bushing while moving along the guide hole relative to the support pin and thereby moves the bushing to a position between the unset position and the set position.

7 Claims, 5 Drawing Sheets

U.S. PATENT DOCUMENTS

| | | | | |
|---|---|---|---|---|
| 6,406,073 | B1 * | 6/2002 | Watanabe | 292/216 |
| 6,793,255 | B2 * | 9/2004 | Kobayashi et al. | 292/216 |
| 7,080,861 | B2 * | 7/2006 | Watanabe | 292/216 |
| 7,568,740 | B2 * | 8/2009 | Brose et al. | 292/216 |
| 2006/0186675 | A1 | 8/2006 | Suzumura et al. | |
| 2007/0075552 | A1 * | 4/2007 | Hayakawa et al. | 292/216 |
| 2008/0023971 | A1 | 1/2008 | Akizuki et al. | |

FOREIGN PATENT DOCUMENTS

| | | | |
|---|---|---|---|
| JP | 2001-152719 | A | 6/2001 |
| JP | 2002-81247 | A | 3/2002 |
| JP | 2002-129808 | A | 5/2002 |
| JP | 2003-328623 | A | 11/2003 |
| JP | 2006-169948 | A | 6/2006 |
| JP | 2006-233456 | A | 9/2006 |

* cited by examiner

DOOR LOCK DEVICE FOR VEHICLE

FIELD OF THE INVENTION

The present invention relates to a vehicle door lock device.

BACKGROUND OF THE INVENTION

Patent document 1 describes an example of a known vehicle door lock device. The vehicle door lock device includes a housing, a latch mechanism, an inside lever, an open lever, an operation lever, and a child protector lever. The latch mechanism holds the vehicle door in a state closing the vehicle body. The inside lever is operated by a vehicle occupant from the passenger compartment of the vehicle to open the vehicle door. The open lever allows the vehicle door to be released from the closed state produced by the latch mechanism. The operation lever is movable to an unset position, enabling the transmission of torque from the inside lever to the open lever, a set position, disabling the transmission of torque. The child protector lever is pivotally coupled to the housing. Pivoting of the child protector lever relative to the housing moves the operation lever between the unset position and the set position. The operation lever and the child protector lever form a child protector mechanism.

In patent document 1, the child protector lever is arranged at a position that is spaced from the inside lever so that the child protector lever may be pivoted about a pivot axis that differs from the pivot axis of the inside lever. This enlarges the child protector mechanism.

Patent Document 1: Japanese Laid-Open Patent Publication No. 2003-328623

SUMMARY OF THE INVENTION

It is an object of the present invention to provide a vehicle door lock device that allows for the child protector mechanism to be reduced in size.

To achieve the above object, a first aspect of the present invention provides a vehicle door lock device. The vehicle lock device includes a latch mechanism, an inside lever, an inside open lever, a movable body, a child protector lever, and an intermediate lever. The latch mechanism holds a vehicle door in a closed state relative to a vehicle body. The inside lever is operable from a passenger compartment side of a vehicle and supported to be pivotal about a pivot shaft arranged in the vehicle door. The inside open lever is pivotally supported by the pivot shaft and releases the vehicle door from the closed state held by the latch mechanism. The movable body is movable to an unset position, enabling torque transmission from the inside lever to the inside open lever, and a set position, disabling the torque transmission. The child protector lever is supported pivotally about the pivot shaft that inputs operation force for moving the movable body. The intermediate lever includes a guide hole, which receives the pivot shaft. The intermediate lever cooperates with the child protector lever and the movable body. When pushed by the child protector lever as the child protector lever pivots, the intermediate lever pushes the movable body while moving along the guide hole relative to the pivot shaft and thereby moves the movable body to a position between the unset position and the set position.

Preferably, the movable body is slidably supported by the inside open lever. As the intermediate lever moves along the guide hole relative to the pivot shaft, the movable body is pushed by the intermediate lever to slidably move the inside open lever and thereby move between the unset position and the set position.

As a result, the inside lever, the inside open lever, and the child protector lever are pivotally supported about the pivot shaft so as to be coaxial with one another. Further, the intermediate lever, which moves the movable body between the unset position and the set position, is guided so as to relatively move the pivot shaft in the guide hole. Thus, the child protector lever and the intermediate lever together with the inside lever and the inside open lever are arranged in concentration near the pivot shaft. This further reduces the size of the child protector mechanism.

Preferably, the vehicle door lock device further includes a guide pin arranged in the vehicle door. The intermediate lever includes an elongated hole extending linearly and parallel to a longitudinal direction of the guide hole and receiving the guide pin. The intermediate lever moves along the elongated hole relative to the guide pin as the guide hole moves relative to the pivot shaft. This moves the movable body between the unset position and the set position.

As a result, the intermediate lever, which moves the movable body between the unset position and the set position, is guided with an extremely simple structure that relatively moves the pivot shaft and the guide pin linearly in the guide hole and the elongated hole, respectively.

Preferably, the movable body includes an engagement projection. The intermediate lever includes an arcuate hole that receives the engagement projection. The arcuate hole is arranged at a position extending along a circumferential direction about the pivot shaft when the movable body is arranged at the unset position.

As a result, the movable body is moved between the unset position and the set position with an extremely simple structure that pushes the engagement projection with the arcuate hole by relatively moving the pivot shaft in the guide hole. Further, as the inside open lever, which supports the movable body, pivots about the pivot shaft when torque is transmitted from the inside lever, the engagement projection moves (freely moves) in the arcuate hole. This avoids interference with the intermediate lever.

Preferably, the latch mechanism is adapted to be attached to the vehicle door. The vehicle door lock device further includes a housing attached to the latch mechanism.

The housing accommodates the inside lever, the inside open lever, the movable body, the child protector lever, and the intermediate lever. Further, the housing supports the pivot shaft.

As a result, a unit may be formed by accommodating the inside lever, the inside open lever, the movable body, the child protector lever, and the intermediate lever in the housing.

Preferably, the inside lever includes an engagement groove cut out towards the pivot shaft along a radial direction of the pivot shaft. The movable body includes a first engagement projection that is engageable with the engagement groove and projects in a direction parallel to the axis of the pivot shaft. When the movable body is arranged at the unset position, the first engagement projection is arranged in the engagement groove. This enables torque transmission from the inside lever to the inside open lever. When the movable body is arranged at the set position, the engagement projection is arranged outside the engagement groove. This disables torque transmission from the inside lever to the inside open lever.

As a result, the switching operation for enabling and disabling torque transmission from the inside lever to the inside open lever is realized with an extremely simple structure that switches the engagement projection and the engagement groove between an engagement state and a disengagement state.

Preferably, the intermediate lever includes an arcuate hole extending along a circumferential direction about the pivot shaft when the movable body is arranged at the unset position. The movable body includes a second engagement projection projecting in a direction parallel to the axis of the pivot shaft so as to be inserted into the arcuate hole. The intermediate lever pushes the second engagement projection with an inner wall of the arcuate hole when moved along the guide hole. This moves the movable body between the unset position and the set position.

As a result, the bushing is moved between the unset position and the set position with an extremely simple structure that pushes the second engagement projection with the arcuate hole by relatively moving the pivot shaft in the guide hole. Further, as the open lever, which supports the bushing, pivots about the pivot shaft when torque is transmitted from the inside lever, the second engagement projection moves (freely moves) in the arcuate hole. This avoids interference with the intermediate lever.

DETAILED DESCRIPTION OF THE PREFERRED EMBODIMENTS

One embodiment of the present invention will now be discussed with reference to the drawings.

Figure 1:
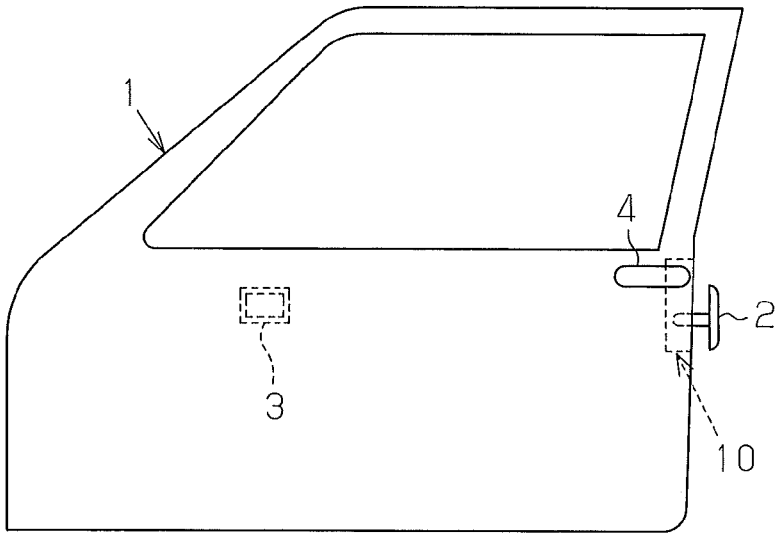
FIG. 1 is a front view showing a vehicle door including a door lock device according to one embodiment of the present invention.

As shown in FIG. 1, a vehicle door 1 includes a door lock device 10 arranged along a rear edge of the vehicle door 1. The door lock device 10 engages a striker 2, which is fixed to the vehicle body (not shown), to hold the vehicle door 1 in a closed state relative to a vehicle body. An inside handle 3 is arranged on an inner wall of the vehicle door 1 in a state exposed to the passenger compartment, and an outside handle 4 is arranged on an outer wall of the vehicle door 1 in a state exposed to the exterior of the passenger compartment.

Figure 2:
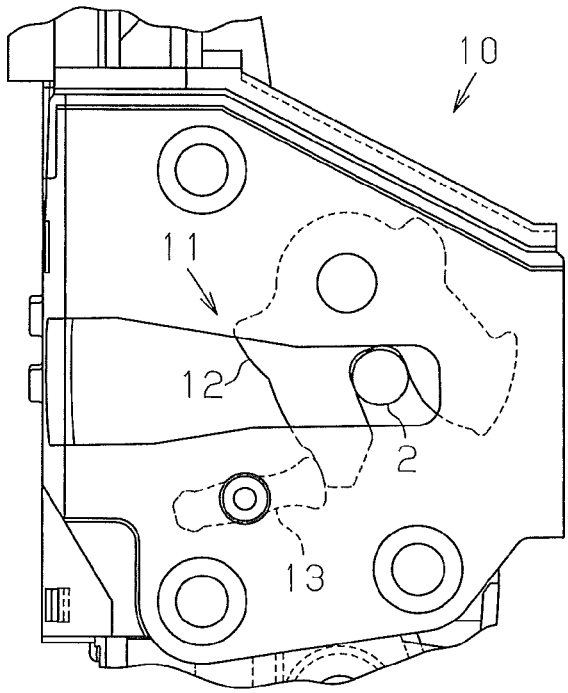
FIG. 2 is an elevation view showing a latch mechanism of the door lock device of FIG. 1.

As shown in FIG. 2, the door lock device 10 includes a latch mechanism 11. The latch mechanism 11 includes a latch 12 and a pawl 13. The latch mechanism 11 engages the striker 2 to hold the vehicle door 1 in the closed state with respect to the vehicle body. When closing the vehicle door 1, the latch 12 rotates in a first direction to engage the striker 2, and the pawl 13 engages the latch 12 to inhibit rotation of the latch 12. This holds the vehicle door 1 in the closed state. When the pawl 13 rotates to permit rotation of the latch 12, the biasing force of a return spring (not shown) rotates the latch 12 in a second direction, which is opposite the first direction. This disengages the latch 12 from the striker 2 and the vehicle door 1 shifts to a state in which it is allowed to open the vehicle body.

Figure 3:
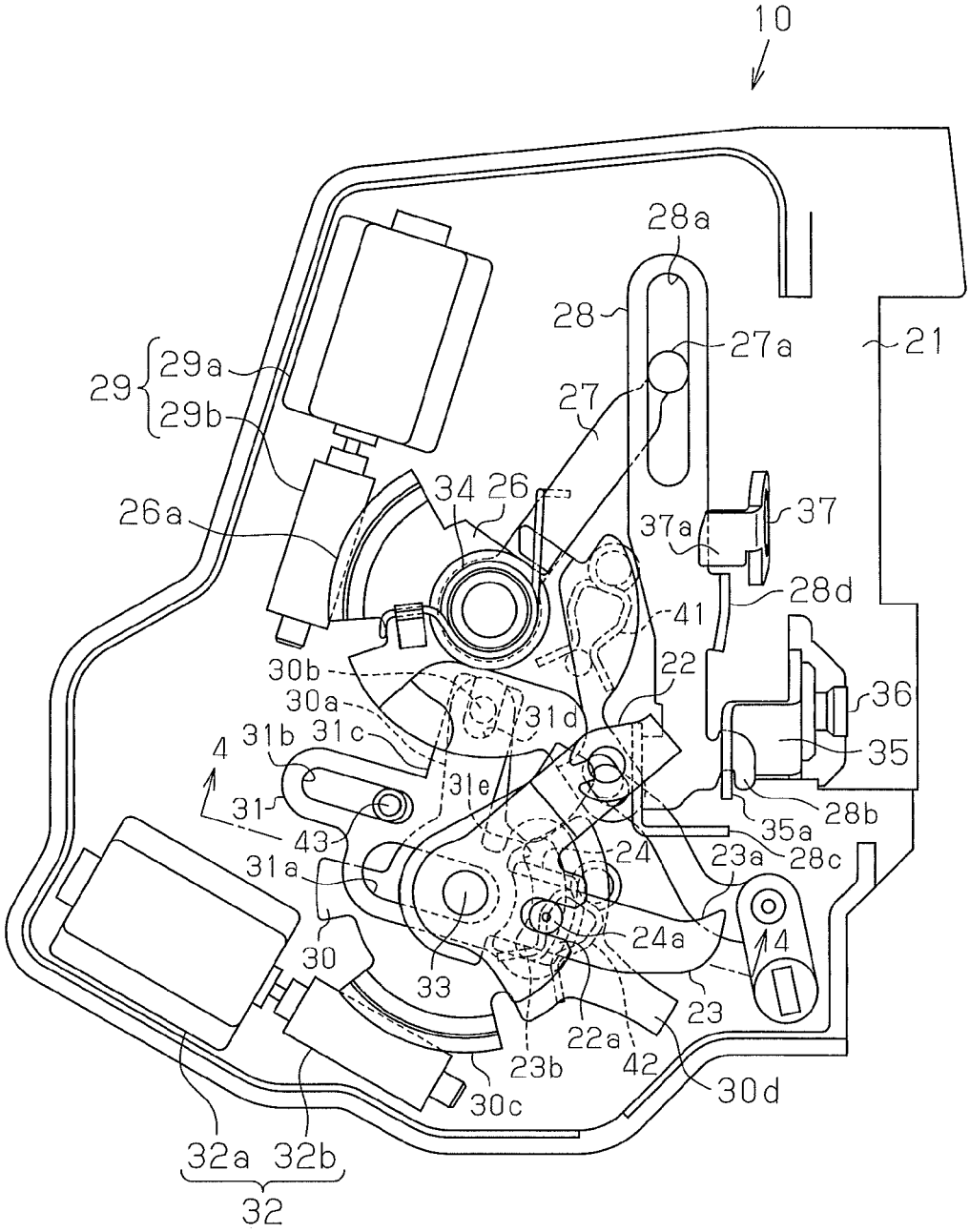
FIG. 3 is a side view of the door lock device of FIG. 1.

The door lock device 10 will now be described in detail with reference to FIGS. 3 to 8. FIG. 3 shows the vehicle door 1 is an unlock state, which is a state in which the vehicle door 1 may be opened by operating the inside handle 3. The state of the door lock device 10 shown in FIG. 3 is referred to as a child lock unset state.

As shown in FIG. 3, the door lock device 10 includes a box-shaped housing 21 and an operation mechanism. The operation mechanism includes an inside lever 22, an inside open lever 23, a bushing 24 serving as a movable body, an active lever 26, a panic lever 27, an open link 28, a lock actuator 29, a child protector lever 30, an intermediate lever 31, and a child protector actuator 32. The housing 21 is adapted to be attachable to the latch mechanism 11 and accommodates the operation mechanism. In other words, the operation mechanism is accommodated in the housing 21 so as to form a unit.

The housing 21 supports a cylindrical support pin 33, which includes a step, serves as a pivot shaft, and extends in a direction orthogonal to the plane of FIG. 3.

The inside lever 22, which is formed from, for example, a metal plate, is supported pivotally about the support pin 33 in the clockwise direction and counterclockwise direction as viewed in FIG. 3 when arranged at a predetermined initial pivot position. The inside lever 22 is coupled to the inside handle 3. The inside lever 22 is pivoted in the counterclockwise direction as viewed in FIG. 3 by the opening operation of the inside handle 3. The inside lever 22 includes a U-shaped engagement groove 22*a* extending along the radial direction towards the support pin 33.

Figure 4:
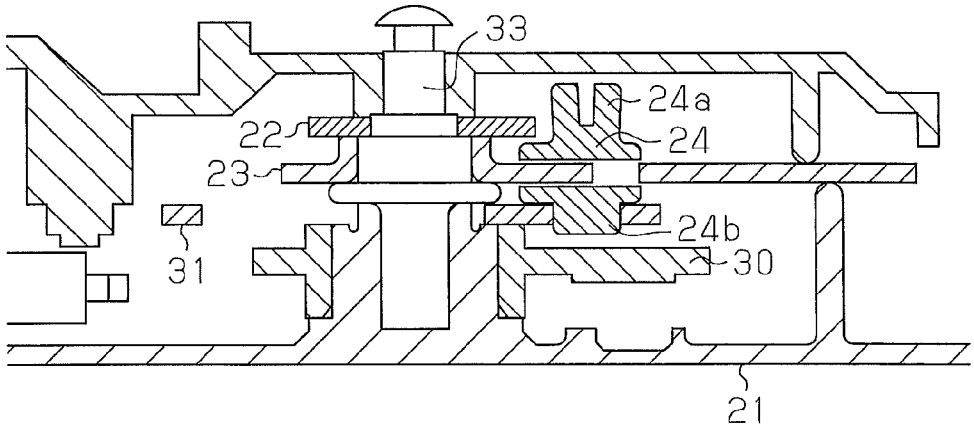
FIG. 4 is a cross-sectional view taken along line 4-4 in FIG. 3.

The inside open lever 23, which is formed from, for example, a metal plate, is supported pivotally about the support pin 33 in the clockwise direction and the counterclockwise direction as viewed in FIG. 3 in the same manner as the inside lever 22. As shown in FIG. 4, the inside open lever 23 is arranged to overlap the inside lever 22 in the axial direction of the support pin 33. The inside open lever 23 includes a hook-shaped push piece 23*a*, which extends radially outward. The push piece 23*a* has a basal portion forming a guide piece 23*b* having parallel sides.

The bushing 24, which is formed from a resin material, has the shape of a flat plate. The bushing 24 is slidable along the longitudinal direction of the guide piece 23*b*. The bushing 24 includes a first engagement projection 24*a*, which is substantially cylindrical and projects upward as viewed in FIG. 4, and a second engagement projection 24*b*, which is substantially cylindrical, projects downward as viewed in FIG. 4, and concentric with the first engagement projection 24*a*. The first engagement projection 24*a* is inserted into the engagement groove 22*a* when the bushing 24 is arranged at a predetermined position near the support pin 33 in the guide piece 23*b*. This restricts rotation of the bushing 24 about the support pin 33 relative to the inside lever 22. In this state, the bushing 24 is capable of transmitting the pivoting force of the inside lever 22 to the inside open lever 23. The position of the bushing 24 in this state is referred to as the unset position.

Figure 7:
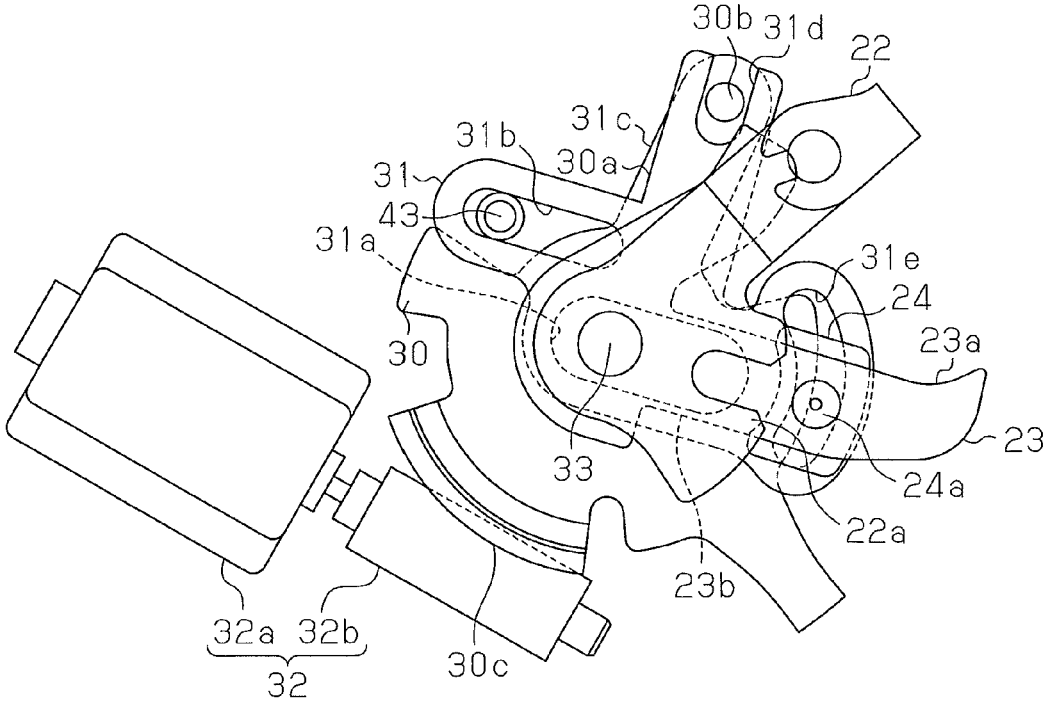
FIG. 7 is a side view showing the door lock device of FIG. 1 and the operation thereof.

As shown in FIG. 7, when the bushing 24 is arranged at a predetermined position near the distal end of the guide piece 23*b*, that is, at the side spaced apart from the support pin 33, the first engagement projection 24*a* is disengaged from the engagement groove 22*a*. As a result, rotation of the bushing 24 relative to the inside lever 22 about the support pin 33 is permitted. In this state, the bushing 24 cannot transmit the pivoting force of the inside lever 22 to the inside open lever 23. The position of the bushing 24 in this state is referred to as the set position. In this manner, as the bushing 24 moves along the guide piece 23*b*, the bushing 24 selectively switches between a state in which the inside lever 22 and the inside open lever 23 are integrally rotatable and a state in which the inside lever 22 and the inside open lever 23 are relatively rotatable.

The active lever 26 is made of resin material, and is supported pivotally in the clockwise direction and counterclockwise direction as viewed in FIG. 3 about an axis differing from the center axis of the support pin 33 relative to the housing 21 within a predetermined pivoting range. The pivoting position of the active lever 26 where pivoting in the clockwise direction in FIG. 3 is restricted is referred to as the unlock position. The pivoting position of the active lever 26 where pivoting in the counterclockwise direction in FIG. 3 is restricted is referred to as the lock position. FIG. 3 shows the active lever 26 at the unlock position. A spring 41 for positioning the active lever 26 is attached to the housing 21. The active lever 26 is biased by the spring 41 and selectively switched between the unlock position and the lock position.

The active lever 26 includes a fan-shaped gear 26*a* extending from the pivot center of the active lever 26 towards the lock actuator 29. The lock actuator 29 includes an electric motor 29*a* and an output gear 29*b* fixed to a rotation shaft of the electric motor 29*a*, and the gear 26*a* of the active lever 26 and the output gear 29*b* of the lock actuator 29 are mated with other. The lock actuator 29 drives and switches the active lever 26 to the unlock position and the lock position.

The panic lever 27, which is formed from a metal plate, is supported pivotally in the clockwise direction and counterclockwise direction as viewed in FIG. 3 relative to the housing 21 and coaxially with the active lever 26. A spring 34 is wound around the rotation shaft of the active lever 26. The spring 34 has a basal end hooked to the active lever 26 and a distal end hooked to the panic lever 27. The panic lever 27 is basically supported to pivot integrally with the active lever 26. A locking pin 27*a* attached to the distal end of the panic lever 27 is projected in a direction orthogonal to the plane of FIG. 3.

The open link 28, which is formed from a metal plate, extends in the vertical direction as viewed in FIG. 3. The open link 28 has a first end portion including an engagement groove 28*a*, which is shaped as an elongated hole, to receive the locking pin 27*a* of the panic lever 27. The open link 28 is supported so that the panic lever 27 is movable in the longitudinal direction of the engagement groove 28*a*.

The open link 28 has a second end portion including a coupling portion 28*b*. The coupling portion 28*b* is coupled to the open lever 35, which is coupled to the housing 21. Thus, the open link 28 is swingable relative to the open lever 35. The open lever 35 is pivotally attached to the housing 21 by the support pin 36. A torsion spring (not shown) stably arranges the support pin 36 at a predetermined pivoting position relative to the housing 21. The open lever 35 has a first end portion 35*a*, which is coupled to the coupling portion 28*b* of the open link 28, and a second end portion, which is coupled to the outside handle 4 and opposite the first end portion 35*a* with the pivot center located in between. When an opening operation is performed with the outside handle 4, the open lever 35 pivots so that the first end portion 35*a*, that is, the coupling portion 28*b* of the open link 28, moves upwards against the torsion spring.

Further, the open link 28 includes an L-shaped first engagement piece 28*c*, which is located under the coupling portion 28*b*, and a hook-shaped second engagement piece 28*d*, which is located between the engagement groove 28*a* and the coupling portion 28*b*. The first engagement piece 28*c* is arranged to face the push piece 23*a* of the inside open lever 23 in the vertical direction. In other words, the first engagement piece 28*c* lies along a pivoting path of the push piece 23*a*. Thus, when the inside open lever 23 pivots in the counterclockwise direction as viewed in FIG. 3, the push piece 23*a* pushes the end face of the engagement piece 28*c* towards the upper side thereby moving the open link 28 upward. The second engagement piece 28*d* is arranged near the lift lever 37, which is pivotally attached to the housing 21. The lift lever 37 is coupled to integrally turn with the pawl 13 shown in FIG. 2. The lift lever 37 includes a distal portion 37*a* at a location facing toward the second engagement piece 28*d*. When the lift lever 37 pivots to move the distal portion 37*a* upward, the pawl 13 is pivoted integrally with the lift lever 37 to permit rotation of the latch 12. This disengages the latch 12 from the striker 2, and the vehicle door 1 may open the vehicle body.

When the vehicle door 1 is in the unlock state, the second engagement piece 28*d* of the open link 28 and the distal portion 37*a* of the lift lever 37 are arranged to face toward each other in the vertical direction. The longitudinal direction of the engagement groove 28*a* is also aligned with the vertical direction. Thus, when moving the open link 28 upward from the state described above, the second engagement piece 28*d* pushes and upwardly moves the distal portion 37*a* thereby disengaging the latch 12 from the striker 2.

When the active lever 26 pivots in the counterclockwise direction as viewed in FIG. 3, the open link 28 pivots in the counterclockwise direction as viewed in FIG. 3 about the coupling portion 28*b*. As a result, the second engagement piece 28*d* is arranged so that a line extending along the longitudinal direction of the engagement groove 28*a* is separated from the distal portion 37*a*. In this state, the distal portion 37*a* cannot be pushed upward by the second engagement piece 28*d* even if the open link 28 is moved upward. This maintains the engagement state of the latch 12 and the striker 2 (lock state of vehicle door 1).

The lock actuator 29 is connected to a control circuit (not shown). Remote operation (locking and unlocking) of a lock/unlock switch arranged on a key blade or a passenger compartment side door trim controls and drives the lock actuator 29 with the control circuit. As described above, the active lever 26 is selectively switched to either one of the unlock position and the lock position when driven by the lock actuator 29.

Figure 5:
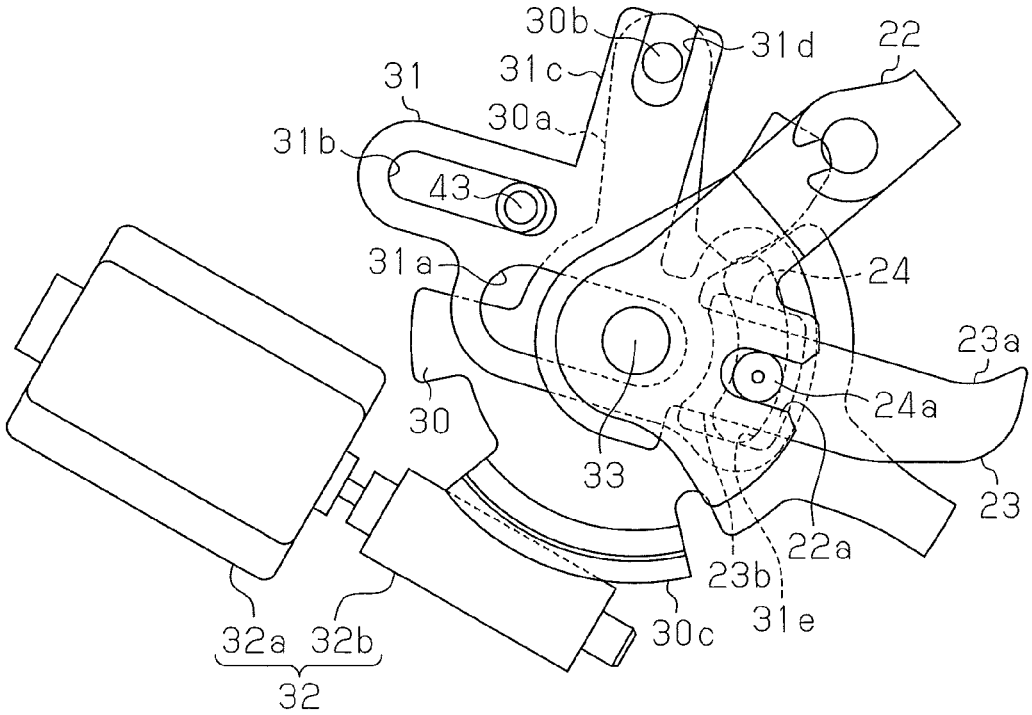
FIG. 5 is a side view showing the door lock device of FIG. 1 and the operation thereof.

The child protector lever 30, which is formed from a resin material, is supported pivotally about the support pin 33 in the clockwise direction and counterclockwise direction as viewed in FIG. 3 within a predetermined pivoting range in the same manner as the inside lever 22 and the inside open lever 23. As shown in FIG. 4, the child protector lever 30 is arranged to overlap the inside open lever 23 in the axial direction of the support pin 33. The pivoting position of the child protector lever 30 at which pivoting in the counterclockwise direction is restricted, shown in the states of FIGS. 3 and 5, is referred to as the child lock unset position of the child protector lever 30. The pivoting position of the child protector lever 30 at which pivoting in the clockwise direction is restricted, shown in the state of FIG. 7, is referred to as the child lock set position of the child protector lever 30. As shown in FIG. 3, a spring 42, which is for positioning the child protector lever 30, is attached to the housing 21. The spring 42 biases and selectively switches the child protector lever 30 to the child lock unset position and the child lock set position.

The child protector lever 30 includes a plate-shaped lever portion 30*a* extending radially outward from the pivot center of the child protector lever 30. A cylindrical engagement projection 30*b* projects from a distal part of the lever portion 30*a* in a direction orthogonal to the plane of FIG. 3. The child protector lever 30 includes a fan-shaped gear 30*c* extending from the pivot center of the child protector lever 30 towards the child protector actuator 32. The child protector actuator 32 includes an electric motor 32*a* and an output gear 32*b* fixed to a rotation shaft of the electric motor 32*a*. The gear 30*c* of the child protector lever 30 and the output gear 32*b* of the child protector actuator 32 are mated with each other. The child protector actuator 32 drives and selectively switches the child protector lever 30 to the child lock unset position and the child lock set position.

The child protector lever 30 includes a plate-shaped operation lever portion 30*d* extending from the pivot center of the child protector lever 30 in a radial direction that differs from the lever portion 30*a*. The operation lever portion 30*d* has a distal part exposed to the outer side of the vehicle door 1. The child protector lever 30 may also be manually switched selectively between the child lock unset position and the child lockset position.

The intermediate lever 31, which is made of a metal plate, includes a linear guide hole 31*a*, which extends along the extending direction of the guide piece 23*b*, and a linear elongated hole 31*b*, which is parallel to the longitudinal direction of the guide hole 31*a*. The guide hole 31*a* receives the support pin 33. As shown in FIG. 4, the intermediate lever 31 is arranged between and overlapped with the inside open lever 23 and the child protector lever 30 in the axial direction of the support pin 33. A guide pin 43, which is fixed to the housing 21, is inserted through the elongated hole 31*b*. The guide pin 43 extends in a direction orthogonal to the plane of FIG. 3. Thus, the intermediate lever 31 is movably supported in the longitudinal direction of the guide hole 31*a* in a range in which the guide hole 31*a* and the elongated hole 31*b* are respectively guided by the support pin 33 and the guide pin 43.

The intermediate lever 31 includes a plate-shaped lever portion 31*c* extending in a direction orthogonal to the longitudinal direction of the guide hole 31*a* at a position adjacent to the lever portion 30*a*. The intermediate lever 31 also includes a U-shaped engagement groove 31*d* extending from the distal end towards the basal end of the lever portion 31*c*. The engagement projection 30*b* is inserted to the engagement groove 31*d*. The intermediate lever 31 includes an arcuate hole 31*e* extending in the circumferential direction at a location closer to the bushing 24 than the guide hole 31*a*. The arcuate hole 31*e* has an arcuate shape and extends about a terminal end region of the guide hole 31*a* at the side of the bushing 24. The second engagement projection 24*b* of the bushing 24 is inserted into the arcuate hole 31*e*. Thus, the arcuate hole 31*e* restricts the movement of the bushing 24 (second engagement projection 24*b*) in the radial direction.

As shown in FIG. 5, when the child protector lever 30 is located at the child lock unset position, the intermediate lever 31 is arranged so that the support pin 33 is positioned at a terminal end region of the guide hole 31*a* at the side of the bushing 24. The arcuate hole 31*e* guides the second engagement projection 24*b*. This arranges the first engagement projection 24*a* in the engagement groove 22*a* of the inside lever 22 and arranges the bushing 24, which is attached to the guide piece 23*b*, at the unset position. In other words, as the intermediate lever 31 moves along the guide hole 31*a* relative to the support pin 33, the bushing 24 is pushed by the intermediate lever 31 so as to slidably move the inside open lever 23. This moves the bushing 24 to the unset position. In this state, the bushing 24 enables transmission of the movement (pivoting) of the inside lever 22 to the inside open lever 23. The arcuate hole 31*e* extends in the circumferential direction about the support pin 33. Thus, when movement is transmitted, the second engagement projection 24*b*, which is inserted into the arcuate hole 31*e*, is pivotal about the support pin 33. This prevents interference with the intermediate lever 31 and permits pivoting of the bushing 24. When the inside lever 22 pivots, the first engagement projection 24*a* of the bushing 24 pushes the inner surface of the engagement groove 22*a* so that the inside open lever 23, which supports the bushing 24, pivots integrally with the inside lever 22.

As shown in FIG. 7, when the child protector lever 30 is located at the child lock set position, the intermediate lever 31 is arranged so that the support pin 33 is positioned at a terminal end region of the guide hole 31*a* at the side opposite to the bushing 24. The arcuate hole 31*e* guides the second engagement projection 24*b*. This arranges the first engagement projection 24*a* outside the engagement groove 22*a* of the inside lever 22 and arranges the bushing 24, which is attached to the guide piece 23*b*, at the set position. In other words, as the intermediate lever 31 moves along the guide hole 31*a* relative to the support pin 33, the bushing 24 is pushed by the intermediate lever 31 so as to slidably move the inside open lever 23. This moves the bushing 24 to the set position. In this state, the bushing 24 disables transmission of the movement (pivoting) of the inside lever 22 to the inside open lever 23.

The child protector actuator 32 is connected to a control circuit (not shown). Remote operation (set and unset operation) of the child protector switch arranged on the key blade or the passenger compartment side door trim controls and drives the child protector actuator 32 with the control circuit. As described above, the child protector lever 30 is selectively switched to either one of the child lock unset position and the child lock set position when driven by the child protector actuator 32.

The operation of the door lock device 10 in the present embodiment will now be discussed.

Figure 6:
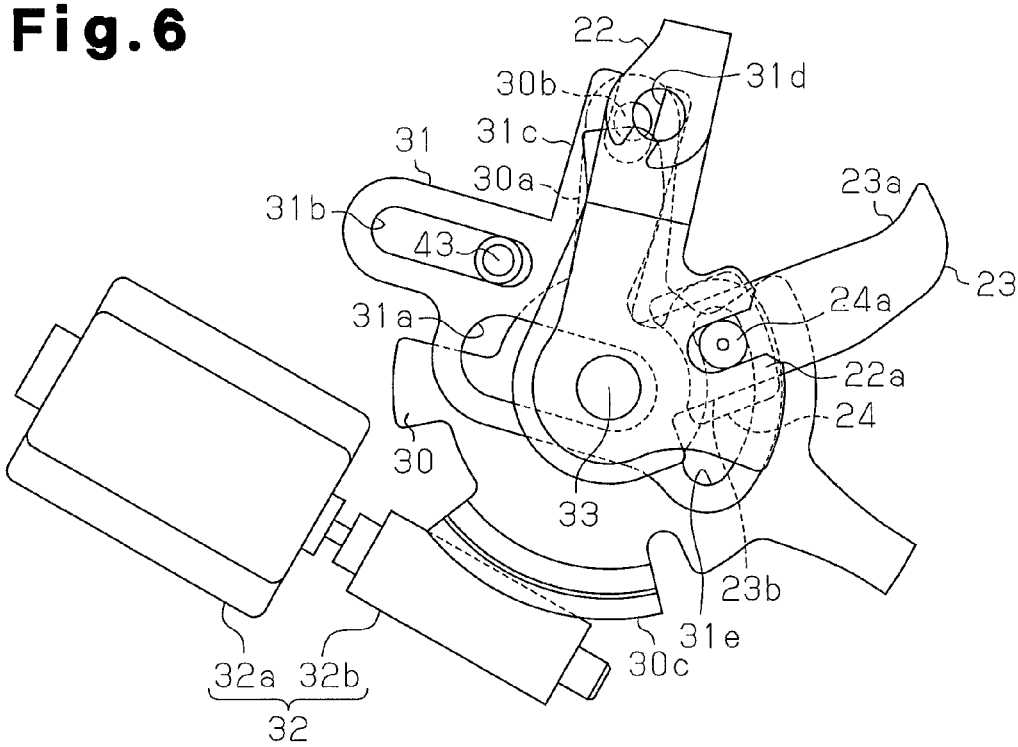
FIG. 6 is a side view showing the door lock device of FIG. 1 and the operation thereof.

As shown in FIGS. 3 and 5, that is, if an opening operation is performed with the inside handle 3 when the vehicle door 1 is in the unlock state and the door lock device 10 in the child lock unset state, the inside lever 22 pivots in the counterclockwise direction as viewed in FIGS. 3 and 5. Then, as shown in FIG. 6, the inside open lever 23, which supports the bushing 24 engaged with the engagement groove 22*a*, pivots integrally with the inside lever 22, and the push piece 23*a* pushes the first engagement piece 28*c* (see FIG. 3) of the open link 28. The distal end 38*a* moves upward since the second engagement piece 28*d* of the open link 28 and the distal portion 37*a* of the lift lever 37 are arranged facing toward each other in the vertical direction. This disengages the latch 12 from the striker 2 and allows the vehicle door 1 to be opened from the vehicle body.

Figure 8:
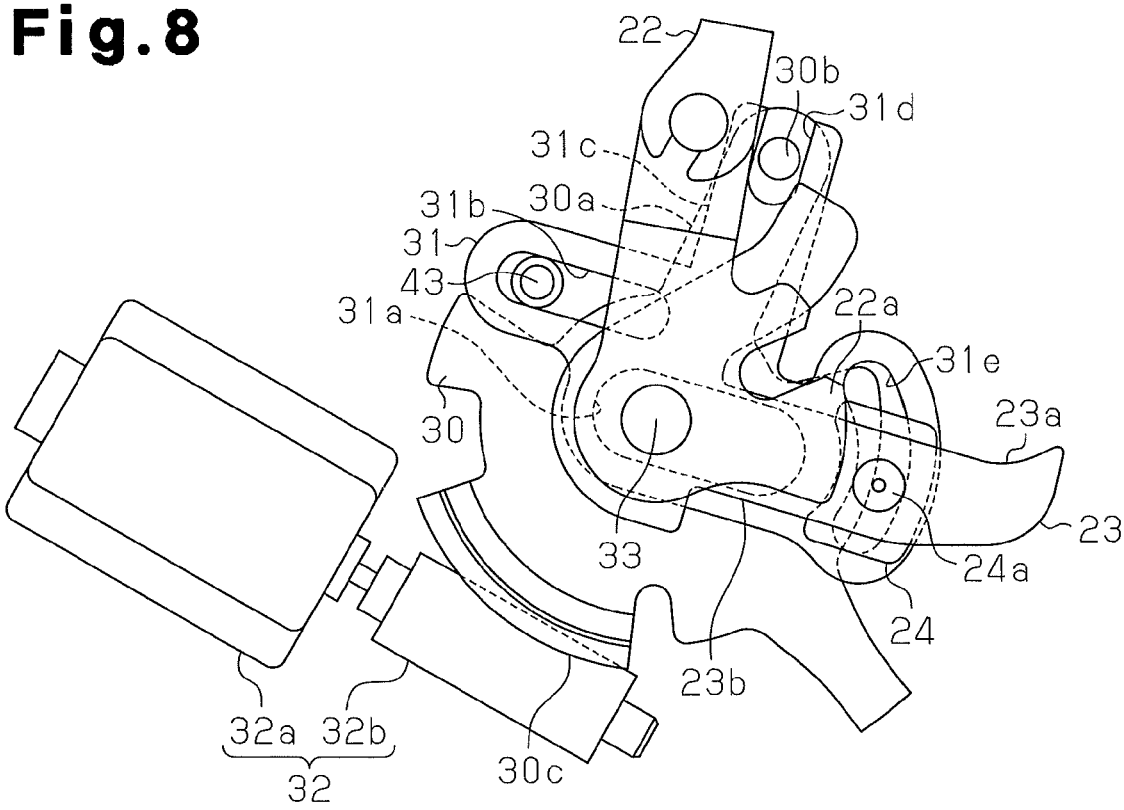
FIG. 8 is a side view showing the door lock device of FIG. 1 and the operation thereof.

When the child protector lever 30 is driven by the child protector actuator 32 and pivoted in the clockwise direction in FIG. 5, the child protector lever 30 moves to the child lock set position. As a result, the engagement projection 30*b* pushes the inner surface of the engagement groove 31*d* towards the right as viewed in FIG. 7, and the intermediate lever 31 moves towards the right in a state in which the guide hole 31*a* and the elongated hole 31*b* are respectively guided by the support pin 33 and the guide pin 43, as shown in FIG. 7. In this state, the arcuate hole 31*e* pushes the second engagement projection 24*b*. Thus, the bushing 24 is moved integrally with the intermediate lever 31 along the guide piece 23*b*. This arranges the first engagement projection 24*a* of the bushing 24 outside the engagement groove 22*a* of the inside lever 22. As a result, the bushing 24 disables transmission of the movement (pivoting) of the inside lever 22 to the inside open lever 23 (child lock set state). Accordingly, in this state, relative rotation of the inside lever 22 and the inside open lever 23 is permitted, and the inside lever 22 pivots freely without the inside open lever 23, as shown in the state of FIG. 8, even when the inside handle 3 is operated to open the vehicle door 1 and the inside lever 22 is pivoted in the counterclockwise direction in FIG. 7. That is, when the pivoting position of the child protector lever 30 is located at the child lock set position, only the inside lever 22 is pivoted. Thus, the latch 12 and the striker 2 will not be disengaged from each other even when the inside handle 3 is operated.

In the unlock state, the latch 12 and the striker 2 are disengaged when the outside handle 4 is operated regardless of the positions of the bushing 24 and the child protector lever 30. That is, when the vehicle door 1 is in the unlock state and the child protector lever 30 is in the child lock set state, the latch mechanism 11 may be operated so that the vehicle door 1 opens from the vehicle body only when operated from outside the vehicle (operation of the outside handle 4).

The members for selectively switching the transmission of torque from the inside lever 22 to the inside open lever 23 between an enable state and a disable state, namely, the bushing 24, the child protector lever 30, the intermediate lever 31, the child protector actuator 32, and the like form a child protector mechanism.

In the present embodiment, members related to the open operation of the vehicle door 1 in the passenger compartment of the vehicle (inside lever 22 and inside open lever 23) and the child protector lever 30 use the support pin 33 as a commonly shared pivot shaft. Further, the support pin 33 is inserted into the guide hole 31*a* of the intermediate lever 31 to guide its movement. This reduces the size of the entire door lock device 10.

As discussed in detail above, the present embodiment has the advantages described below.

(1) In the present embodiment, the inside lever 22, the inside open lever 23, and the child protector lever 30 are pivotally supported about the support pin 33 so as to be coaxial with one another. Further, the intermediate lever 31, which moves the bushing 24 between the unset position and the set position, is guided so as to relatively move the support pin 33 in the guide hole 31*a*. In this manner, the inside lever 22, the inside open lever 23, the child protector lever 30, and the intermediate lever 31 are arranged overlapped with one another in the axial direction of the support pin 33. Thus, the child protector lever 30 and the intermediate lever 31 are arranged in concentration near the support pin 33 together with the inside lever 22 and the inside open lever 23. This further reduces the size of the child protector mechanism. Thus, the door lock device 10 may be further reduced in size.

(2) In the present embodiment, the intermediate lever 31, which moves the bushing 24 between the unset position and the set position, is guided with an extremely simple structure that relatively moves the support pin 33 and the guide pin 43 linearly in the guide hole 31*a* and the elongated hole 31*b*, respectively.

(3) In the present embodiment, the switching operation for selectively enabling and disabling the transmission of torque from the inside lever 22 to the inside open lever 23 is realized with an extremely simple structure that switches the first engagement projection 24*a* of the bushing 24 and the engagement groove 22*a* between an engagement state and a disengagement state.

(4) In the present embodiment, the bushing 24 is moved between the unset position and the set position with an extremely simple structure that pushes the second engagement projection 24*b* with the arcuate hole 31*e* by relatively moving the support pin 33 in the guide hole 31*a*. Further, as the inside open lever 23, which supports the bushing 24, pivots about the support pin 33 when torque is transmitted from the inside lever 22 to the inside open lever 23, the second engagement projection 24*b* moves (freely moves) in the arcuate hole 31*e* thereby avoiding interference with the intermediate lever 31.

(5) In the present embodiment, the engagement projections 24*a* and 24*b* project in opposite directions concentric with each other. Thus the occupied space is reduced in size compared to when the engagement projections 24*a* and 24*b* are separated from each other.

The above-described embodiment may be modified as discussed below.

In the above-described embodiment, the engagement projections 24*a* and 24*b* do not have to be arranged coaxially with each other as long as they may cooperate with the inside lever 22 and the intermediate lever 31, respectively.

In the above-described embodiment, the engagement projections 24*a* and 24*b* may be arranged so as to project in the same direction as long as they may cooperate with the inside lever 22 and the intermediate lever 31, respectively. In this case, the engagement projections 24*a* and 24*b* may be formed integrally by a single projection.

In the above-described embodiment, only one of the inside lever 22, the inside open lever 23, and the child protector lever 30 may be fixed to the support pin 33 so as to rotate integrally with the support pin 33.

In the above-described embodiment, an electromagnetic solenoid or the like may be used as a drive unit for the lock actuator 29 and the child protector actuator 32.

The invention claimed is:

1. A vehicle door lock device comprising:

a latch mechanism positionable in an engaged state to hold a vehicle door in a closed state relative to a vehicle body and movable to a disengaged state to permit the vehicle door to be opened;

an inside lever operatively connected to a handle at a passenger compartment side of a vehicle door and pivotally supported about a pivot shaft supported in a housing to transmit torque;

an inside open lever pivotally supported on the pivot shaft to receive the torque transmitted from the inside lever and thereby pivot to transmit the torque;

an open link having a portion that receives the torque transmitted from the inside open lever, the open link moving in response to the torque transmitted from the inside open lever to transmit the torque;

a lift lever that receives the torque transmitted from the open link to move the latch mechanism from the engaged state to the disengaged state;

a child protector actuator;

an intermediate lever including a guide hole in which is located the pivot shaft, a child protector lever supported pivotally about the pivot shaft and operatively connected to the child protector actuator to move in response to operation of the child protector actuator;

a movable body movable along a portion of the inside open lever between an unset position, enabling transmission of the torque from the inside lever to be transmitted to the inside open lever, and a set position disabling said transmission of the torque;

wherein operation of the child protector actuator to move the child protector lever in one direction causes the child protector lever to push the intermediate lever so the intermediate lever moves the movable body to the unset position allowing the torque produced by the inside lever upon operation of the handle to be transmitted to the lift lever to move the latch mechanism from the engaged state to the disengaged state; and wherein operation of the child protector actuator to move the child protector lever in a direction opposite the one direction causes the child protector lever to push the intermediate lever so the intermediate lever moves the movable body to the set position not allowing the torque produced by the inside lever upon operation of the handle to be transmitted to the lift lever.

2. The vehicle door lock device according to claim 1, wherein the movable body is slidably supported by the inside open lever, and movement of the intermediate lever relative to the pivot shaft causes the intermediate lever to push the movable body and slidably move the inside open lever.

3. The vehicle door lock device according to claim 1, further comprising a guide pin fixed to the housing, and an elongated hole in the intermediate lever extending linearly and parallel to a longitudinal direction of the guide hole, the guide pin being positioned in the elongated hole.

4. The vehicle door lock device according to claim 1, wherein the movable body includes an engagement projection, and the intermediate lever includes an arcuate hole in which is positioned the engagement projection, the arcuate hole being arranged at a position extending along a circumferential direction about the pivot shaft when the movable body is arranged at the unset position.

5. The vehicle door lock device according to claim 1, wherein the housing accommodates the inside lever, the inside open lever, the movable body, the child protector lever, and the intermediate lever.

6. The vehicle door lock device according to claim 1, wherein the inside lever includes an engagement groove cut out towards the pivot shaft along a radial direction of the pivot shaft, and the movable body includes a first engagement projection engageable with the engagement groove and projecting in a direction parallel to the axis of the pivot shaft.

7. The vehicle door lock device according to claim 1, wherein the intermediate lever includes an arcuate hole extending along a circumferential direction about the pivot shaft when the movable body is arranged at the unset position, the movable body including a second engagement projection projecting in a direction parallel to the axis of the pivot shaft so as to be positioned in the arcuate hole.

* * * * *